US007893334B2

(12) United States Patent
Iwamoto et al.

(10) Patent No.: US 7,893,334 B2
(45) Date of Patent: Feb. 22, 2011

(54) PEDAL APPARATUS OF ELECTRONIC MUSICAL INSTRUMENT

(75) Inventors: Toshiyuki Iwamoto, Hamamatsu (JP); Shigeru Muramatsu, Mori-machi (JP); Hisashi Takeyama, Hamamatsu (JP)

(73) Assignee: Yamaha Corporation (JP)

( * ) Notice: Subject to any disclaimer, the term of this patent is extended or adjusted under 35 U.S.C. 154(b) by 50 days.

(21) Appl. No.: 12/403,171

(22) Filed: Mar. 12, 2009

(65) Prior Publication Data

US 2009/0229440 A1 Sep. 17, 2009

(30) Foreign Application Priority Data

Mar. 17, 2008 (JP) ..... 2008-067054
Jan. 13, 2009 (JP) ..... 2009-004442

(51) Int. Cl.
*G10D 13/02* (2006.01)

(52) U.S. Cl. ..... 84/422.1

(58) Field of Classification Search ..... 84/422.1, 84/422.2, 422.3, 423 R, 426; 74/560, 561, 74/562.5

See application file for complete search history.

(56) References Cited

U.S. PATENT DOCUMENTS 7,387,048 B2 * 6/2008 Furuta et al. ..... 74/560

FOREIGN PATENT DOCUMENTS

JP 2004-334008 A 11/2004

* cited by examiner

*Primary Examiner*—Kimberly R Lockett
(74) *Attorney, Agent, or Firm*—Rossi, Kimms & McDowell LLP

(57) ABSTRACT

A lever 40 is supported by a lever supporting portion 41. The lever 40 is urged by a spring 45. A friction producing member 47 is in contact with a pivot restricting member 46 which is interlocked with the lever 40 to produce a frictional force in a direction opposite to the direction in which the lever 40 pivots. Such a configuration allows a pedal apparatus to exhibit hysteresis in characteristics of the amount of depression of the lever 40 and reaction force.

7 Claims, 9 Drawing Sheets

PEDAL APPARATUS OF ELECTRONIC MUSICAL INSTRUMENT

BACKGROUND OF THE INVENTION

1. Field of the Invention

The present invention relates to a pedal apparatus of an electronic musical instrument, the pedal apparatus being provided in order to control the mode in which a musical tone is generated.

2. Description of the Related Art

Conventionally, it is known that a pedal apparatus of an electronic musical instrument is designed such that a player is provided with a feeling similar to that the player feels when he manipulates a pedal of an acoustic piano. As for a pedal apparatus described in Japanese Unexamined Patent Publication No. 2004-334008, for example, a lever which pivots when it is depressed by a player and a first spring and a second spring for urging the lever are provided in parallel. If the lever is slightly depressed, only the first spring urges the lever. If the lever is depressed to a certain degree or more, the first spring and the second spring urge the lever. As a result, the player perceives his depression as becoming heavier at a certain point of his depression. By such a scheme, the disclosed pedal apparatus imitates the feeling that the player feels when he depresses a damper pedal of an acoustic piano.

SUMMARY OF THE INVENTION

As for an acoustic piano, when a player depresses a damper pedal, hysteresis occurs in characteristics of varying reaction forces against depression of the lever according to an amount of depression of the lever. The reaction forces of the lever, which is generated by depression of a damper pedal of the acoustic piano, will be described with reference to FIG. 12. The lever of the damper pedal is connected with the damper through movable parts, a cushion member, a spring and an axis. Due to viscosity and frictions of the entire pedal apparatus, therefore, hysteresis occurs in characteristics of varying reaction forces against depression of the lever according to an amount of depression of the lever as shown by solid lines in FIG. 12. More specifically, the player perceives the manipulation of the lever as lighter when he releases the pedal than when he depresses it. As for a shift pedal of an acoustic piano as well, a lever is connected to a keyboard through movable parts, a cushion member, a spring and an axis. As shown by dashed lines in FIG. 12, therefore, hysteresis occurs in reaction force with respect to the amount of depression of the lever. Because the shift pedal causes lateral shift of the entire keyboard, the shift pedal is more susceptible to the influence of frictions than the damper pedal. As a result, the shift pedal exhibits hysteresis having a wider width than that of the damper pedal. In other words, difference of the reaction force of the lever between the depression and the release of the lever becomes larger comparing the damper pedal. However, the conventional pedal apparatus of an electronic musical instrument as described above is designed such that the lever is only urged by the springs, having a small number of movable parts that form the entire apparatus. As a result, the viscosity and frictions of the entire conventional pedal apparatus are low, resulting in a narrow hysteresis width in characteristics of varying reaction forces against depression of the lever according to an amount of depression of the lever. Consequently, the conventional pedal apparatus fails to make the player perceive any difference of reaction force against the manipulation of the pedal between depressing the pedal and releasing it, being short of reproducing the feeling that the player perceives when he manipulates a pedal of an acoustic piano. Due to the narrow hysteresis width of the conventional pedal apparatus, in addition, even insignificant variation in the force exerted by the player to depress the pedal results in variation in the amount of depression, making it difficult for the player to control the mode in which a musical tone is generated.

The present invention was accomplished to solve the above-described problems, and an object thereof is to provide a pedal apparatus of an electronic musical instrument which realizes the feeling similar to that a player perceives when he manipulates a damper pedal of an acoustic piano and makes it easy for the player to control the mode in which a musical tone is generated by providing the pedal apparatus with hysteresis similar to that of an acoustic piano in characteristics of varying reaction forces against depression of the lever according to an amount of depression of the lever.

A pedal apparatus of an electronic musical instrument by the present invention has a lever (40, 57) which pivots by depression thereof and an urging means (45) which exerts a reaction force against depression of the lever (40, 57) on the lever (40, 57). In order to achieve the above-described object, the pedal apparatus further comprises a pivot restricting member (46, 46A, 57*a*) which is interlocked with the lever (40, 57) and restricts pivoting of the lever (40, 57); and a friction producing member (47, 47A) which is supported by a supporting member (48, 49, 56, FR) and is in contact with the pivot restricting member (46, 46A, 57*a*) to produce a friction force, wherein the pedal apparatus exhibits hysteresis in characteristics of varying reaction forces against depression of the lever (40, 57) according to an amount of depression of the lever (40, 57). In this case, the pivot restricting member (46, 46A) may be formed separately from the lever (40). In this case, in addition, the pivot restricting member (57*a*) may be formed integrally with the lever (57). In this case, in addition, a pedal apparatus of an electronic musical instrument may further comprises a movable supporting member (51) which pivots in response to pivoting of the lever (40), wherein the pivot restricting member (46) is fixed to the movable supporting member (51).

According to the present invention configured as described above, on the pivot restricting member (46, 46A, 57*a*) interlocked with the lever (40, 57), a frictional force is exerted in a direction opposite to the direction in which the lever (40, 57) pivots, resulting in the pedal apparatus exhibiting hysteresis in characteristics of varying reaction forces against depression of the lever (40, 57) according to an amount of the depression of the lever (40, 57). Furthermore, by controlling the friction force generated on the pivot restricting member (46, 46A, 57*a*) by varying the size of the area where the friction producing member (47, 47A) is in contact with the pivot restricting member (46, 46A, 57*a*), the material of the friction producing member (47, 47A) or the like, the width of hysteresis can be changed. Even though the width of hysteresis varies between the damper pedal and the shift pedal of an acoustic piano, for example, therefore, the present invention can reproduce respective characteristics of the respective pedals. Therefore, the pedal apparatus of the present invention can realize the feeling similar to that a player perceives when he manipulates a pedal of an acoustic piano, making it easy for the player to control the mode in which a musical tone is generated. In the case where the pivot restricting member (57*a*) is formed integrally with the lever (57), in addition, the integral formation allows reduction in component count and reduction in workload of assembly processes, also contributing to cost-reduction.

Further, the supporting member may be a spring (48) which urges the friction producing member (47) toward the pivot restricting member (46) to bring the friction producing member (47) into contact with the pivot restricting member (46). In addition, the supporting member may be a magnet (56) which attracts the pivot restricting member (46) to bring the pivot restricting member (46) into contact with the friction producing member (47). Furthermore, the friction producing member (47, 47A) itself may be made of an elastic material so that elasticity of the friction producing member (47, 47A) brings the friction producing member (47, 47A) into contact with the pivot restricting member (46, 46A). In addition, the supporting member (49) may be made of an elastic material so that elasticity of the supporting member (49) brings the friction producing member (47) into contact with the pivot restricting member (46). In addition, the pivot restricting member (46A) is made of an elastic material so that elasticity of the pivot restricting member (46A) brings the pivot restricting member (46A) into contact with the friction producing member (47A). In this case, for example, the friction producing member (47A) is fixed to a frame (FR) which is the supporting member. The friction producing member (47A) may be elastically deformed or may not be elastically deformed. Furthermore, the pivot restricting member (46, 57*a*) may be supported by the lever so that the pivot restricting member (46, 57*a*) elastically deform in a direction perpendicular to a surface which is in contact with the friction producing member (47).

According to the present invention configured as described above, on the pivot restricting member (46, 46A) interlocked with the lever (40), a frictional force is more stably exerted in a direction opposite to the direction in which the lever pivots, resulting in the pedal apparatus exhibiting stable hysteresis in characteristics of varying reaction forces against depression of the lever (40) according to an amount of the depression of the lever (40). Therefore, the pedal apparatus of the present invention can realize, in spite of its simple configuration compared with an acoustic piano, a feeling similar to that a player perceives when he manipulates a pedal of an acoustic piano, making it easy for the player to control the mode in which a musical tone is generated.

DESCRIPTION OF THE PREFERRED EMBODIMENT

Figure 1:
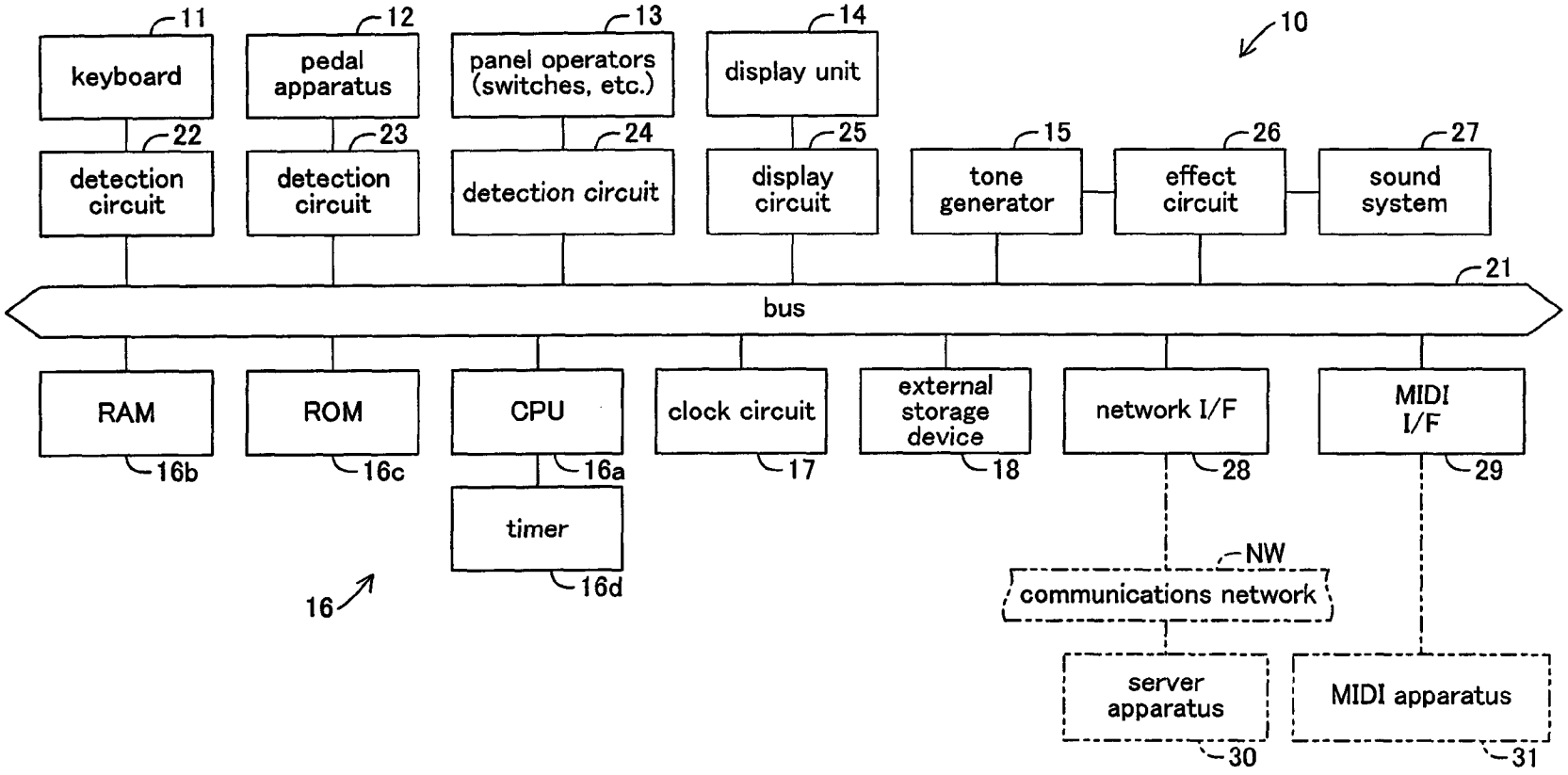
FIG. 1 is a block diagram showing an example of an entire configuration of an electronic musical instrument to which a pedal apparatus according to an embodiment of the present invention is applied.

An embodiment of the present invention will now be described with reference to the drawings. FIG. 1 is a block diagram showing a general configuration of an electronic musical instrument to which a pedal apparatus according to the present invention is applied. An electronic musical instrument 10 has a keyboard 11, a pedal apparatus 12, a plurality of panel operators 13, a display unit 14, a tone generator 15, a computer portion 16, a clock circuit 17 and an external storage device 18.

The keyboard 11 is operated with player's hands to specify a pitch of a musical tone to be generated. Each operation of the keyboard 11 is detected by a detection circuit 22 connected to a bus 21 to supply data (e.g., note data, key-on data, key-off data) indicative of the operation to the computer portion 16 via the bus 21. The pedal apparatus 12 is operated with a player's foot to control the mode in which a musical tone is generated by the electronic musical instrument 10. In this embodiment, the pedal apparatus 12 is a damper pedal or a shift pedal. More specifically, by a depression of the damper pedal with a player's foot, a damper effect is added to a musical tone to be generated. By depression of the shift pedal with a player's foot, a tone variation effect is added to a musical tone to be generated. As described in detail later, each operation of the pedal apparatus 12 is detected by a detection circuit 23 connected to the bus 21 to supply data indicative of the operation to the computer portion 16 via the bus 21.

The plurality of panel operators 13 are provided in order to allow a player to program operations of the electronic musical instrument. Each operation of the panel operators 13 is detected by a detection circuit 24 connected to the bus 21 to supply data indicative of the operation to the computer portion 16 via the bus 21. The display unit 14, which is formed of a liquid crystal display, CRT or the like, displays characters, numerals, graphics and the like on a screen. The display unit 14 is controlled by a display circuit 25 connected to the bus 21. The display circuit 25 specifies what to display on the basis of instruction signals and data supplied to the display circuit 25 via the bus 21.

The tone generator 15, which is connected to the bus 21, generates digital musical tone signals on the basis of musical tone control data (note data, key-on data, key-off data, tone color control data, loudness control data, etc.) supplied from the computer portion 16 via the bus 21 and supplies the generated digital musical tone signals to an effect circuit 26. The effect circuit 26, which is connected to the bus 21, adds effects to the supplied digital musical tone signals on the basis of effect control data supplied from the computer portion 16 via the bus 21 and supplies the digital musical signals to which the effects have been added to a sound system 27. The above-described effect by manipulation of the damper pedal and the shift pedal is added to digital musical tone signals by the tone generator 15 or the effect circuit 26. The sound system 27, which is configured by a D/A converter, amplifiers, speakers and the like, converts the supplied digital musical tone signals to which the effects have been added to analog musical tone signals and emits musical tones corresponding to the analog musical tone signals.

The computer portion 16 is formed of a CPU 16*a*, a RAM 16*b* and a ROM 16*c* connected to the bus 21 as well as a timer 16*d* connected to the CPU 16*a*. The computer portion 16 executes programs to control the electronic musical instrument 10. The clock circuit 17 continuously measures date and time. The external storage device 18, which includes a hard disk and flash memory incorporated into the electronic musical instrument 10, various kinds of storage media such as a compact disk connectable to the electronic musical instrument 10 and drive units for the storage media, can store and read a large amount of data and programs.

The electronic musical instrument 10 further includes a network interface circuit 28 and a MIDI interface circuit 29. The network interface circuit 28 connects the electronic musical instrument 10 to a server apparatus 30 via a communications network NW so that the electronic musical instrument 10 can communicate with the server apparatus 30. The MIDI interface circuit 29 connects the electronic musical instrument 10 to an external MIDI apparatus 31 such as another electronic musical instrument or a sequencer so that the electronic musical instrument 10 can communicate with the external MIDI apparatus 31.

Figure 2:
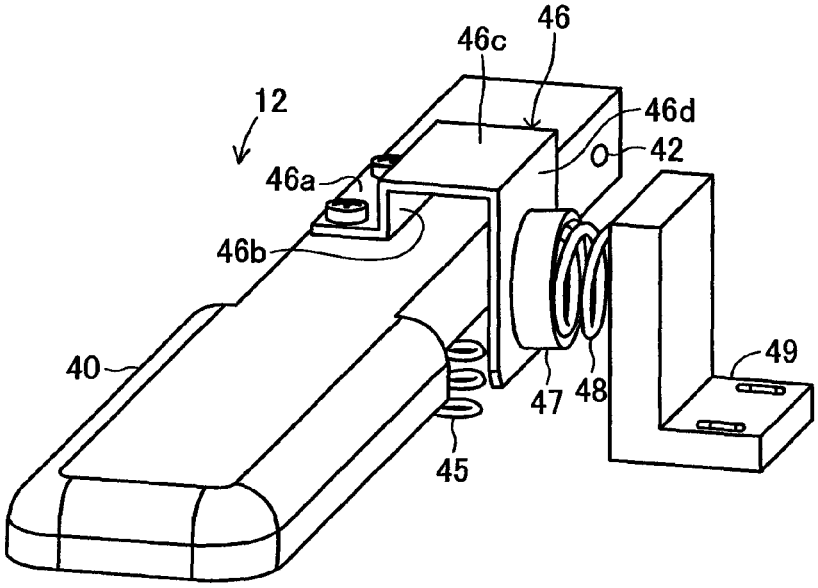
FIG. 2 is a perspective view schematically showing the entire pedal apparatus according to the embodiment of the present invention.
Figure 3A:
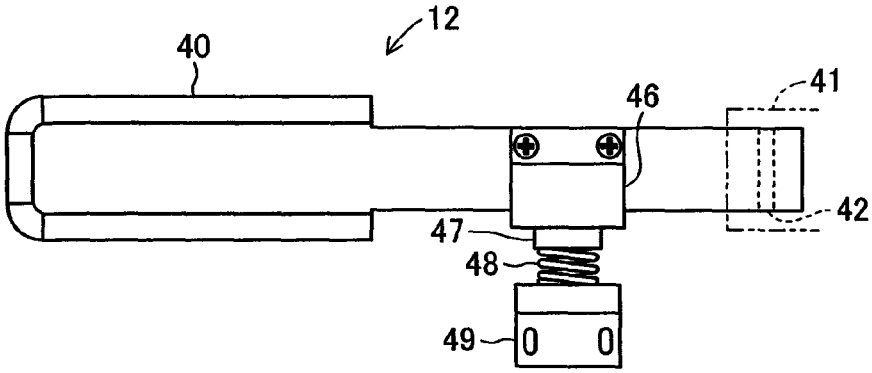
FIG. 3A is a top view of the pedal apparatus shown in FIG. 2.
Figure 3B:
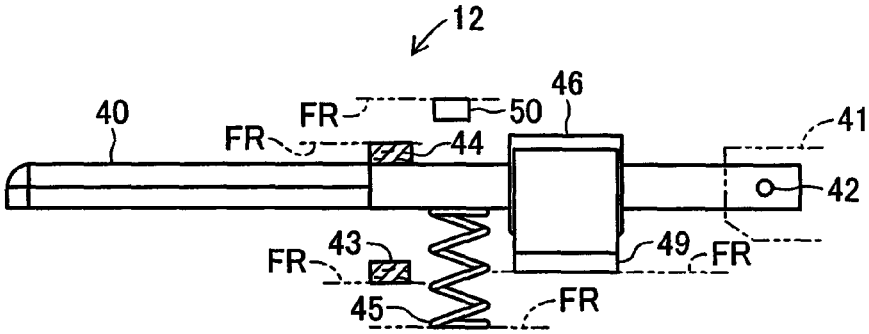
FIG. 3B is a side view of the pedal apparatus shown in FIG. 2.

Next, the pedal apparatus 12 according to the present invention will be described in detail. The configuration of a damper pedal is same as the configuration of a shift pedal, although characteristics of varying reaction forces against depression of levers are different between the damper pedal and shift pedal. Therefore, the damper pedal and the shift pedal will be described later as a common pedal apparatus 12. FIG. 2 is a perspective view schematically showing the entire pedal apparatus 12 of the present embodiment. FIGS. 3A and 3B are respectively a top view and a side view of the pedal apparatus 12. A lever 40 is formed of a long plate-like member. The forward part of the lever 40 (the left side in FIG. 3A and FIG. 3B) is a broad pedal portion which a player depresses. On the rear part, the lever 40 is supported by a lever supporting portion 41 provided on a frame FR so that the front end of the lever 40 can vertically pivot about a rotation pivot 42. On the forward part of the frame FR, a long lower limit stopper 43 formed of a shock absorbing member such as felt extends laterally, being fixed to the frame FR. The lower limit stopper 43 restricts downward displacement of the forward part of the lever 40. The frame FR is a structure for supporting various parts of the pedal apparatus 12 and a housing itself of the pedal apparatus 12. Above the middle part of the lever 40, an upper limit stopper 44 similar to the lower limit stopper 43 is fixed to the frame FR to restrict upward displacement of the forward part of the lever 40.

Under the middle part of the lever 40, a spring 45 is fixed to the frame FR to urge the forward part of the lever 40 upward. Above the middle part of the lever 40, a pivot restricting member 46 is provided.

The pivot restricting member 46 is formed of a bent metal plate. More specifically, the pivot restricting member 46 is comprised a rectangular supporting portion 46*a* which is parallel with the top surface of the lever 40, a vertical portion 46*b* which stands erect from one longer side of the supporting portion 46*a*, a top surface portion 46*c* which laterally extends from the top end of the vertical portion 46*b* in the direction opposite to the supporting portion 46*a*, and a contact portion 46*d* which vertically droops from the extended end of the top surface portion 46*c*. The pivot restricting member 46 is fixed to the top surface of the lever 40 on the supporting portion 46*a*. The contact portion 46*d* is placed outside the side surface of the lever 40 so that there is clearance between the contact portion 46*d* and the lever 40. The pivot restricting member 46 is formed of a material which has relatively high stiffness but is elastically deformable. More specifically, the contact portion 46*d* can elastically deform in the vertical direction to a certain degree.

With the outside surface of the contact portion 46*d* of the pivot restricting member 46, a friction producing member 47 is in contact. The friction producing member 47, which is made of artificial leather, felt or the like, is in contact with the pivot restricting member 46 to produce friction on the surface which is in contact with the pivot restricting member 46. The friction producing member 47 is supported by a spring 48 which serves as a supporting member so that the friction producing member 47 is urged toward the pivot restricting member 46. In other words, the friction producing member 47 is fixed to one end of the spring 48. The other end of the spring 48 is fixed to a supporting member 49 fixed to the frame FR so that the spring 48 is supported by the supporting member 49. The friction producing member 47 is allowed to travel only in a direction perpendicular to the contact portion 46*d* of the pivot restricting member 46 by a guide member which is not shown.

On the inside ceiling surface of the frame FR, a depression sensor 50 for sensing an amount of depression of the lever 40 is provided. The depression sensor 50 electrically or optically (e.g., reflection of laser light) senses a distance to the top surface of the lever 40 to obtain an amount of depression of the lever 40. The depression sensor 50 is part of the detection circuit 23. Instead of the depression sensor 50, a sensor which mechanically and electrically (e.g., variable resistance) senses an amount of upward and downward displacement of the lever 40 may be employed.

Next, operation of the pedal apparatus 12 configured as described above will be explained. In a state where the lever 40 is not depressed, the forward part of the lever 40 is urged upward by the spring 45. As a result, the top surface of the middle part of the lever 40 is in contact with the upper limit stopper 44, so that the lever 40 stands still, resulting in a state shown in FIG. 3A and FIG. 3B.

If a player depresses the lever 40 in spite of the urging force exerted by the spring 45, the lever 40 pivots counterclockwise about the rotation pivot 42 in FIG. 3B, so that the forward part of the lever 40 is displaced downward. At the time of the pivoting, friction caused by the contact is produced between the pivot restricting member 46 and the friction producing member 47, resulting in upward kinetic frictional force being exerted on the pivot restricting member 46. In addition, the urging force by the spring 48 causes the pivot restricting member 46 to slightly elastically deform toward the lever 40. As a result, lateral deflection of the lever 40 produced at the time of the manipulation of the lever 40 is absorbed to allow the pivot restricting member 46 to exert further stable kinetic frictional force. On the lever 40, as a result, in addition to the urging force by the spring 45, the kinetic frictional force is exerted as a reaction force. If the undersurface of the middle part of the lever 40 comes into contact with the lower limit stopper 43, downward displacement of the forward part of the lever 40 is restricted.

If the depression of the lever 40 is released, the urging force by the spring 45 causes the lever 40 to pivot clockwise about the rotation pivot 42 in FIG. 3B, so that the forward part of the lever 40 is displaced upward. At the time of the pivoting, friction caused by the contact is produced between the pivot restricting member 46 and the friction producing member 47, resulting in downward kinetic frictional force being exerted on the pivot restricting member 46. As in the case of the depression of the lever 40, in addition, the pivot restricting member 46 elastically deforms, resulting in stable kinetic frictional force being exerted on the pivot restricting member 46. On the lever 40, as a result, force obtained by subtracting the kinetic frictional force from the urging force by the spring 45 is exerted as reaction force. If the top surface of the middle part of the lever 40 comes into contact with the upper limit stopper 44, upward displacement of the forward part of the lever 40 is restricted, so that the lever 40 recovers to the original state (FIG. 3A and FIG. 3B). The depression of the lever 40 as described above is sensed by the depression sensor 50 to add the effect of the pedal depression to a musical tone according to the type of the pedal (more specifically, the damper pedal or the shift pedal) and the amount of depression of the lever 40.

Figure 12:
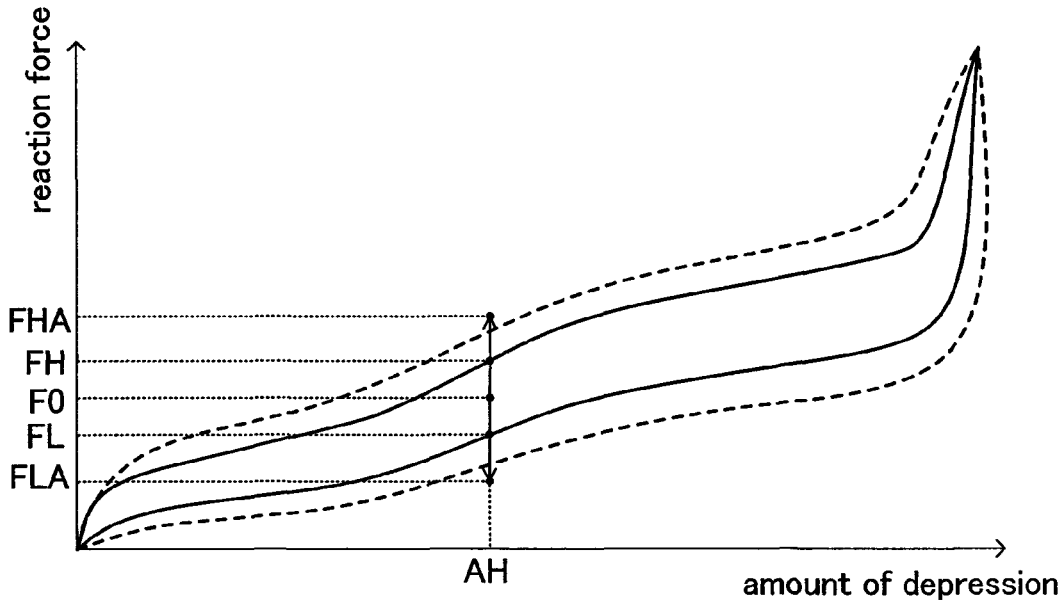
FIG. 12 is a graph showing variation characteristics of an amount of depression of a lever of an acoustic piano and reaction force exerted by the lever.

By exerting frictional force on the pivot restricting member 46 in the direction opposite to the direction in which the lever 40 pivots, the pedal apparatus 12 of the present embodiment configured as described above can exhibit hysteresis similar to that of an acoustic piano shown in FIG. 12 in characteristics of an amount of depression of the lever 40 and reaction force of the lever 40. The friction force generated on the pivot restricting member 46 can be changed by varying the size of the area where the friction producing member 47 is in contact with the pivot restricting member 46, the material of the friction producing member (47, 47A) or the like. Therefore, hysteresis characteristics of the damper pedal and the shift pedal of an acoustic piano can be reproduced respectively.

Because the pedal apparatus 12 of the present embodiment exhibits hysteresis in the reaction force of the lever 40, the pedal apparatus 12 can broaden an acceptable range of depression force for keeping a target amount of depression of the lever. The keeping of the target amount of depression will be described in detail, referring to the hysteresis of the damper pedal shown by solid lines in FIG. 12. In a case where the player keeps an amount of depression at AH, and then depresses the lever again or returns the lever 40 again, for example, the static friction acts on the lever 40 immediately before the lever 40 moves. In a case where the player depresses the lever 40 again, therefore, the reaction force generated immediately before the move of the lever 40 (FHA in the figure) is larger than the reaction force generated when the kinetic friction force acts on the lever 40 (FH in the figure). In a case where the player returns the lever 40 again, the reaction force generated immediately before the move of the lever 40 (FLA in the figure) is smaller than the reaction force generated when the kinetic friction force acts on the lever 40 (FL in the figure). In other words, unless the player increases the depression force to exceed FHA, the amount of depression will not increase. Unless the player decreases the depression force to fall below FLA, the amount of the depression will not decrease. Therefore, the pedal apparatus 12 makes it easy for the player to keep a target amount of depression, also facilitating player's control of the manner in which musical tones are generated. The above-described hysteresis of the damper pedal can be similarly applied to the shift pedal as well.

In carrying out the present invention, furthermore, it will be understood that the present invention is not limited to the above-described embodiment, but various modifications may be made without departing from the spirit and scope of the invention.

Figure 4:
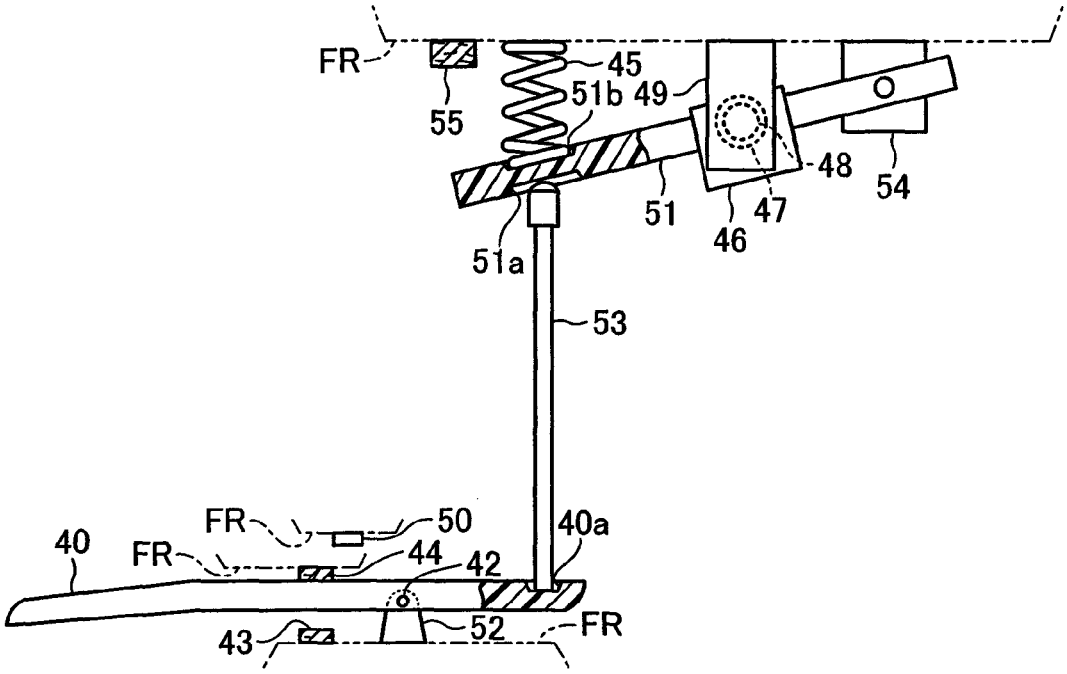
FIG. 4 is a side view of a pedal apparatus according to a modification of the embodiment.

The above-described embodiment is designed such that the pivot restricting member 46 is fixed to the top surface of the lever 40. As shown in FIG. 4, however, the embodiment may be modified to have a movable supporting member 51 which pivots in response to the lever 40 so that the pivot restricting member 46 is fixed to the movable supporting member 51. As for the modification shown in FIG. 4, the lever 40 is supported at a middle part thereof by a lever supporting portion 52 provided on the frame FR so that the front end of the lever 40 is allowed to pivot upward and downward about the rotation pivot 42. The range in which the lever 40 can pivot is defined by the lower limit stopper 43 and the upper limit stopper 44 which are similar to those of the above-described embodiment. By the sensor 50, in addition, the displacement of the lever 40 is sensed. Into a concave portion 40*a* provided on the top surface of the rear part of the lever 40, the lower end of a drive rod 53 is inserted to be in contact with the concave portion 40*a*. The drive rod 53, which is a rodlike member which extends vertically, is guided by a guide member which is not shown so that the drive rod 53 can move only upward and downward in response to pivoting of the lever 40. The top end of the drive rod 53 is inserted into a concave portion 51*a* provided on the undersurface of the forward part of the movable supporting member 51 to be in contact with the upper bottom surface of the concave portion 51*a*.

The movable supporting member 51, which is a plate-shaped member which extends from the front toward the rear of the pedal apparatus, is supported at the rear end of the movable supporting member 51 by a supporting portion 54 fixed to the frame FR so that the front end of the movable supporting member 51 can pivot upward and downward. Above the forward part of the movable supporting member 51, a movable supporting member upper limit stopper 55 is fixed to the frame FR to restrict upward displacement of the forward part of the movable supporting member 51. The spring 45 is provided between the frame FR and the top surface of the movable supporting member 51. The lower end of the spring 45 is inserted into a concave portion 51*b* provided on the top surface of the forward part of the movable supporting member 51 to be fixed to the bottom surface of the concave portion 51*b* to be supported. The top end of the spring 45 is fixed to the frame FR situated above the movable supporting member 51. The spring 45 urges the front end of the lever 40 upward through the movable supporting member 51 and the drive rod 53. At a middle part of the movable supporting member 51, the pivot restricting member 46 which is similar to that of the above-described embodiment is provided. Similarly to the above-described embodiment, in addition, the modification is provided with the friction producing member 47, the spring 48 and the supporting member 49 so that the friction producing member 47 is in contact with the pivot restricting member 46.

Such a configuration also allows the movable supporting member 51 to pivot in response to the depression of the lever 40 to produce, between the pivot restricting member 46 provided on the movable supporting member 51 and the friction producing member 47 supported by the spring 48, the kinetic friction force acting in a direction opposite to the direction in which the movable supporting member 51 pivots. The movable supporting member 51 is urged by a combined force formed of repulsion of the spring 45 and the kinetic friction force. The urging force is conveyed to the lever 40 through the drive rod 53 to be the reaction force against the depression of the lever 40. Similarly to the above-described embodiment, therefore, the modification can exhibit hysteresis in the characteristics of the amount of depression and the reaction force of the lever 40, the hysteresis being similar to that of an acoustic piano.

Figure 5:
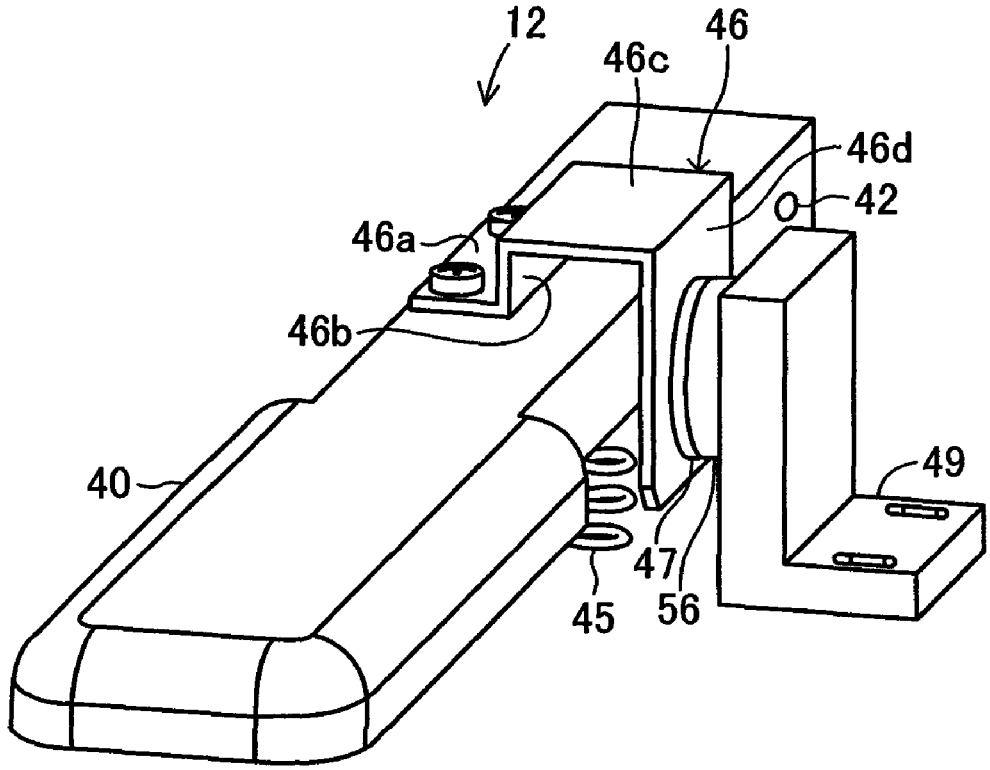
FIG. 5 is a perspective view schematically showing an entire pedal apparatus according to the other modification of the embodiment.
Figure 6A:
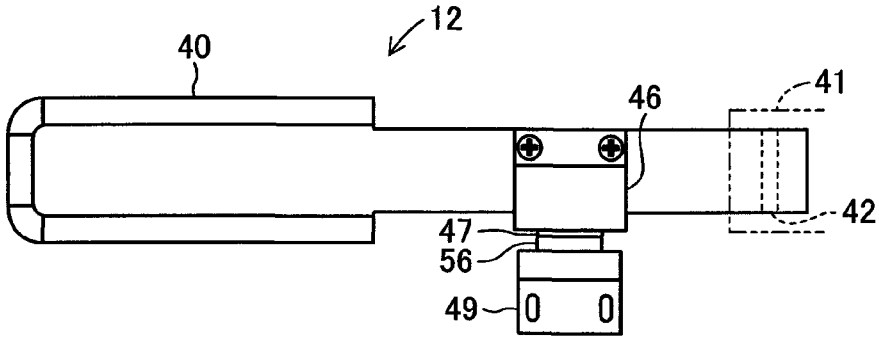
FIG. 6A is a top view of the pedal apparatus shown in FIG. 5.
Figure 6B:
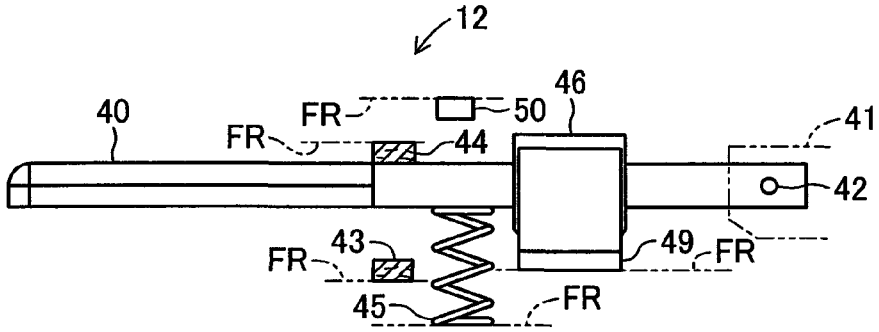
FIG. 6B is a side view of the pedal apparatus shown in FIG. 5.

In the above-described embodiment and modification, the spring 48 is employed in order to urge the friction producing member 47 toward the pivot restricting member 46 so that the friction producing member 47 is in contact with the pivot restricting member 46. However, a magnet 56 may be employed as shown in FIG. 5, FIG. 6A and FIG. 6B. More specifically, the magnet 56 is fixed to the supporting member 49 so that the magnet 56 faces the contact portion 46*d* of the pivot restricting member 46. The friction producing member 47 is fixed to a surface of the magnet 56, the surface facing the contact portion 46*d*. In this modification, the pivot restricting member 46 is formed of a magnetic substance. Except the magnet 56 and the pivot restricting member 46, this modification is configured similarly to the above-described embodiment.

In the case of the modification configured as described above as well, the contact portion 46*d* of the pivot restricting member 46 is attracted by magnetic force of the magnet 56, so that the friction producing member 47 is in contact with the contact portion 46*d* of the pivot restricting member 46. The magnetic force of the magnet 56 is inversely proportional to the second power of a distance from the magnet 56. Although the distance between the magnet 56 and the contact portion 46*d* of the pivot restricting member 46 is determined according to the thickness of the friction producing member 47, the thickness of the friction producing member 47 is almost uniform. Therefore, variations in the force exerted by the magnet 56 for attracting the contact portion 46*d* of the pivot restricting member 46 during player's performance are small. As a result, the modification can exert further stable kinetic frictional force in the direction opposite to the direction in which the lever 40 pivots on the pivot restricting member 46, exhibiting hysteresis similar to that of an acoustic piano in characteristics of an amount of depression of the lever 40 and reaction force of the lever 40.

Figure 7A:
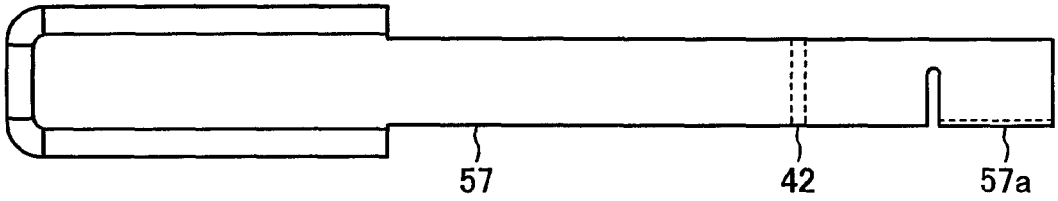
FIG. 7A is a top view of a lever according to another example modification of the embodiment.
Figure 7B:
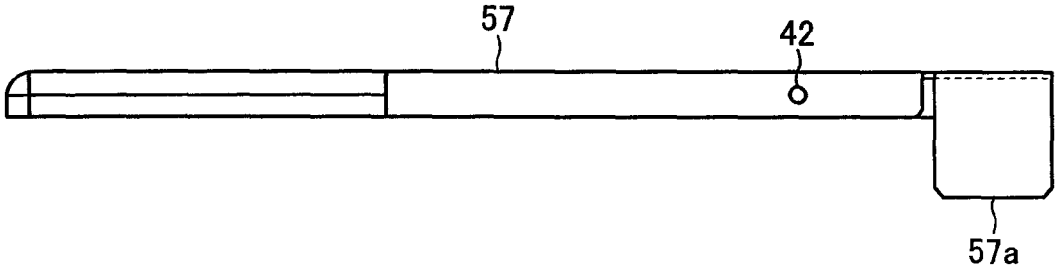
FIG. 7B is a side view of the lever shown in FIG. 7A.

As for the above-described embodiment, the pivot restricting member 46 which is separated from the lever 40 is fixed to the top surface of the lever 40. Instead of this configuration, a lever 57 which is integral with a pivot restricting portion 57*a* may be employed. FIG. 7A and FIG. 7B are respectively a top view and a side view of the lever 57. In this modification, as shown in the figure, the lever 57 is designed to have a rear part shaped like a plate which is thinner than a forward part. The rear part has a pivot restricting portion 57*a* shaped like a flat plate provided on a side surface of the rear part of the lever 52. This modification is designed such that the friction producing member 47 is in contact with the pivot restricting portion 52*a*. As for the modification provided with the movable supporting member 51, furthermore, the movable supporting member 51 may be formed, similarly to the lever 57, to integrally include a flat pivot restricting member on its side surface of the movable supporting member 51.

Figure 8:
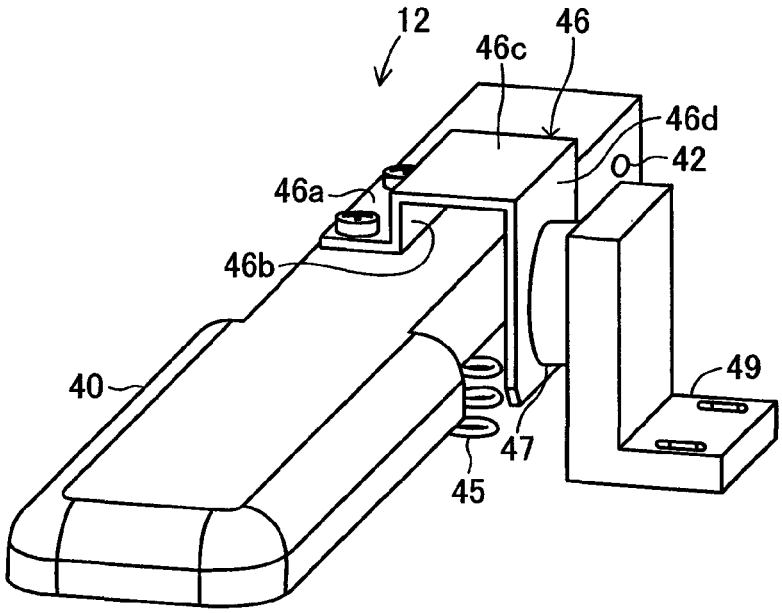
FIG. 8 is a perspective view schematically showing an entire pedal apparatus according to the another example modification of the embodiment.
Figure 9A:
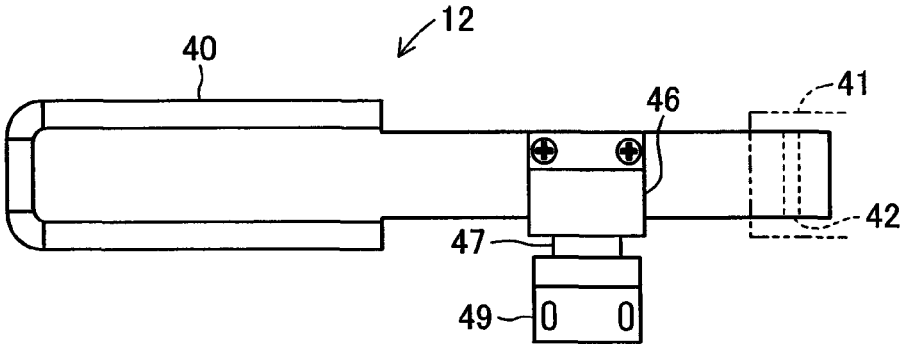
FIG. 9A is a top view of the pedal apparatus shown in FIG. 8.
Figure 9B:
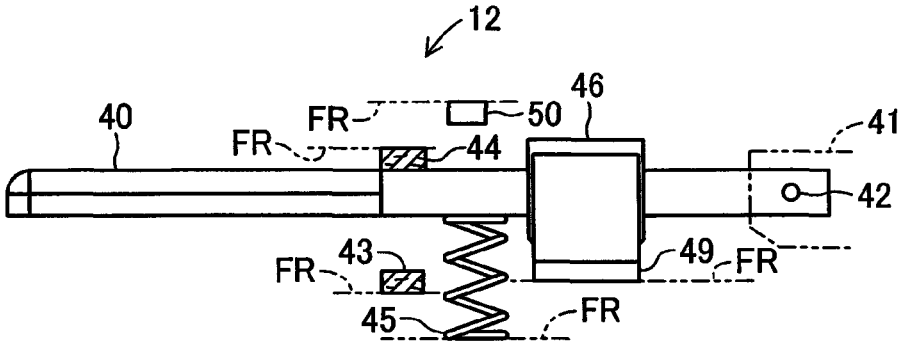
FIG. 9B is a side view of the pedal apparatus shown in FIG. 8.

The above-described embodiment and the modification thereof are designed such that the friction producing member 47 is urged toward the pivot restricting member 46 by the spring 48 so that the friction producing member 47 is in contact with the contact portion 46*d* of the pivot restricting member 46. Furthermore, the other modification of the above-described embodiment is designed such that the pivot restricting member 46 is urged toward the friction producing member 47 by the magnet 56 so that the friction producing member 47 is in contact with the contact portion 46*d* of the pivot restricting member 46. As shown in FIG. 8, FIG. 9A and FIG. 9B, however, the spring 48 and the magnet 56 may be omitted so that the elasticity of the friction producing member 47 allows the friction producing member 47 to be in contact with the pivot restricting member 46. In this case, the elastic deformability of the contact portion 46*d* of the pivot restricting member 46 may be reduced. Alternatively, the contact portion 46*d* may not be elastically deformable.

Furthermore, the supporting member 49 may be elastically deformable in some degree in a direction perpendicular to the contact portion 46*d* of the pivot restricting member 46. The elasticity of the supporting member 49 allows the friction producing member 47 to be in contact with the pivot restricting member 46.

Figure 10:
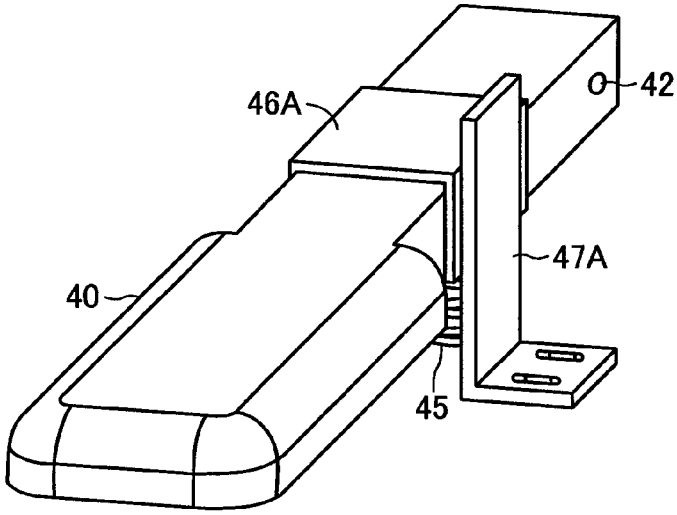
FIG. 10 is a perspective view schematically showing an entire pedal apparatus according to the other modification of the embodiment.
Figure 11A:
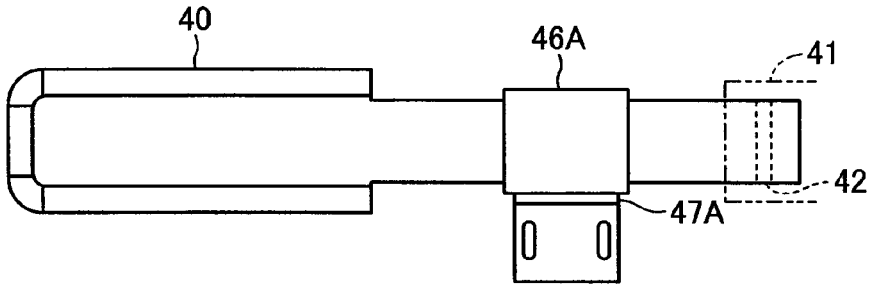
FIG. 11A is a top view of the pedal apparatus shown in FIG. 10.
Figure 11B:
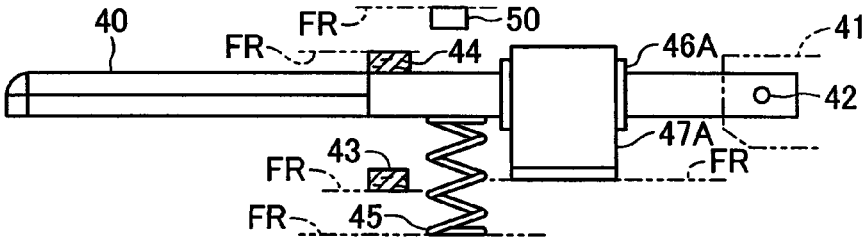
FIG. 11B is a side view of the pedal apparatus shown in FIG. 10.

As shown in FIG. 10, FIG. 11A and FIG. 11B, furthermore, a pivot restricting member 46A may be an elastic member such as artificial leather or felt and may be fixed to the lever 40. A friction producing member 47A, which is a metal plate formed of a vertical portion and a horizontal portion, is employed. The horizontal portion of the friction producing member 47A is fixed to the frame FR which serves as a supporting member. The vertical portion of the friction producing member 47A is in contact with the pivot restricting member 46A. The friction producing member 47A may be elastically deformed or may not be elastically deformed. If the friction producing member 47A is elastically deformed in a direction perpendicular to the contact surface of the pivot restricting member 46A, the elasticity of the friction producing member 47A allows the friction producing member 47A to be in contact with the pivot restricting member 46A.

Such a configuration allows reduction in component count and reduction in workload of assembly processes, also contributing to cost-reduction.

In the above-described embodiment and the modifications thereof, the pedal apparatus 12 is applied to the damper pedal and the shift pedal of the electronic musical instrument. However, the pedal apparatus 12 can be also applied to a sostenuto pedal of an electronic musical instrument.

What is claimed is:

1. A pedal apparatus of an electronic musical instrument comprising:

a lever which pivots by depression thereof;

an urging means which exerts a reaction force against depression of the lever on the lever;

a pivot restricting member which is interlocked with the lever and restricts pivoting of the lever; and a friction producing member which is supported by a supporting member and is in contact with the pivot restricting member to produce a friction force, wherein the supporting member is a spring which urges the friction producing member toward the pivot restricting member to bring the friction producing member into contact with the pivot restricting member, and wherein the pedal apparatus exhibits hysteresis in characteristics of varying reaction forces against depression of the lever according to an amount of depression of the lever.

2. A pedal apparatus of an electronic musical instrument comprising:

a lever which pivots by depression thereof;

an urging means which exerts a reaction force against depression of the lever on the lever;

a pivot restricting member which is interlocked with the lever and restricts pivoting of the lever; and a friction producing member which is supported by a supporting member and is in contact with the pivot restricting member to produce a friction force, wherein the supporting member is a magnet which attracts the pivot restricting member to bring the pivot restricting member into contact with the friction producing member, and wherein the pedal apparatus exhibits hysteresis in characteristics of varying reaction forces against depression of the lever according to an amount of depression of the lever.

3. A pedal apparatus of an electronic musical instrument comprising:

a lever which pivots by depression thereof;

an urging means which exerts a reaction force against depression of the lever on the lever;

a pivot restricting member which is interlocked with the lever and restricts pivoting of the lever; and a friction producing member which is supported by a supporting member and is in contact with the pivot restricting member to produce a friction force, wherein the friction producing member is made of an elastic material so that elasticity of the friction producing member brings the friction producing member into contact with the pivot restricting member, and wherein the pedal apparatus exhibits hysteresis in characteristics of varying reaction forces against depression of the lever according to an amount of depression of the lever.

4. A pedal apparatus of an electronic musical instrument comprising:

a lever which pivots by depression thereof;

an urging means which exerts a reaction force against depression of the lever on the lever;

a pivot restricting member which is interlocked with the lever and restricts pivoting of the lever; and a friction producing member which is supported by a supporting member and is in contact with the pivot restricting member to produce a friction force, wherein the supporting member is made of an elastic material so that elasticity of the supporting member brings the friction producing member into contact with the pivot restricting member, and wherein the pedal apparatus exhibits hysteresis in characteristics of varying reaction forces against depression of the lever according to an amount of depression of the level.

5. A pedal apparatus of an electronic musical instrument comprising:

a lever which pivots by depression thereof;

an urging means which exerts a reaction force against depression of the lever on the lever;

a pivot restricting member which is interlocked with the lever and restricts pivoting of the lever; and a friction producing member which is supported by a supporting member and is in contact with the pivot restricting member to produce a friction force, wherein the pivot restricting member is made of an elastic material so that elasticity of the pivot restricting member brings the pivot restricting member into contact with the friction producing member, and wherein the pedal apparatus exhibits hysteresis in characteristics of varying reaction forces against depression of the lever according to an amount of depression of the lever.

6. A pedal apparatus of an electronic musical instrument comprising:

a lever which pivots by depression thereof;

an urging means which exerts a reaction force against depression of the lever on the lever;

a pivot restricting member which is interlocked with the lever and restricts pivoting of the lever; and a friction producing member which is supported by a supporting member and is in contact with the pivot restricting member to produce a friction force, wherein the pedal apparatus exhibits hysteresis in characteristics of varying reaction forces against depression of the lever according to an amount of depression of the lever, and wherein the pivot restricting member is formed integrally with the lever.

7. A pedal apparatus of an electronic musical instrument comprising:

a lever which pivots by depression thereof;

an urging means which exerts a reaction force against depression of the lever on the lever;

a pivot restricting member which is interlocked with the lever and restricts pivoting of the lever; and a friction producing member which is supported by a supporting member and is in contact with the pivot restricting member to produce a friction force, wherein the pivot restricting member is supported by the lever so that the pivot restricting member elastically deform in a direction perpendicular to a surface which is in contact with the friction producing member, and wherein the pedal apparatus exhibits hysteresis in characteristics of varying reaction forces against depression of the lever according to an amount of depression of the lever.

* * * * *